United States Patent [19]

Meyer et al.

[11] Patent Number: 4,988,560

[45] Date of Patent: Jan. 29, 1991

[54] ORIENTED MELT-BLOWN FIBERS, PROCESSES FOR MAKING SUCH FIBERS, AND WEBS MADE FROM SUCH FIBERS

[75] Inventors: Daniel E. Meyer, Stillwater, Minn.; Dennis L. Krueger, Hudson, Wis.; Hassan Bodaghi, St. Paul, Minn.

[73] Assignee: Minnesota Mining and Manufacturing Company, St. Paul, Minn.

[21] Appl. No.: 135,693

[22] Filed: Dec. 21, 1987

[51] Int. Cl.[5] ..... D04H 1/52; D04H 1/54; D04H 1/72; D04H 1/74

[52] U.S. Cl. ..... 428/297; 2/243 R; 428/296; 428/298; 428/303; 428/902; 428/903

[58] Field of Search ..... 428/296, 297, 298, 303

[56] References Cited

U.S. PATENT DOCUMENTS

| | | | |
|---|---|---|---|
| 3,016,599 | 1/1962 | Perry | 28/78 |
| 3,502,763 | 3/1970 | Hartmann | 264/210 |
| 3,571,679 | 3/1971 | Van Turnhout | 317/262 |
| 3,704,198 | 11/1972 | Prentice | 161/148 |
| 3,971,373 | 7/1976 | Braun | 128/146.2 |
| 4,041,203 | 8/1977 | Brock et al. | 428/157 |
| 4,048,364 | 9/1977 | Harding | 428/113 |
| 4,118,531 | 10/1978 | Hauser | 428/224 |
| 4,196,245 | 4/1980 | Kitson et al. | 428/198 |
| 4,215,682 | 8/1980 | Kubik et al. | 128/205.29 |
| 4,217,387 | 8/1980 | Viezee et al. | 428/288 |
| 4,302,495 | 11/1981 | Marra | 428/110 |
| 4,340,563 | 7/1982 | Appel et al. | 264/518 |
| 4,375,718 | 3/1983 | Wadsworth et al. | 29/592 E |
| 4,429,001 | 1/1984 | Kolpin et al. | 428/283 |
| 4,434,204 | 2/1984 | Hartmann et al. | 428/198 |
| 4,496,508 | 1/1985 | Hartmann et al. | 264/167 |
| 4,547,420 | 10/1985 | Krueger et al. | 428/229 |
| 4,588,537 | 5/1986 | Klaase | 264/22 |
| 4,592,815 | 6/1986 | Nakao | 204/165 |
| 4,622,259 | 11/1986 | McAmish et al. | 428/171 |

FOREIGN PATENT DOCUMENTS

3542660A1 4/1987 Fed. Rep. of Germany .

OTHER PUBLICATIONS

Wente, Van A., "Superfine Thermoplastic Fibers", *Industrial Engineering Chemistry*, vol. 48, p. 1342 et seq. (1956).

Wente, V. A.; Boone, C. D.; and Fluharty, E. L., Report No. 4364 Naval Research Laboratories, May 25, 1954, "Manufacture of Superfine Organic Fibers".

Buntin, Roger A. and Lohkamp, Dwight D., "Melt--Blown—A One-Step Process for New Non-Woven Products", TAPPI, vol. 56, No. 4, Apr., 1973.

McCulloch, W. John & VandBrederode, Robert A., "Technical Developments in the Melt-Blowing Process and its Applications in Absorbent Products", presented at Insight '81, copyright Marketing/Technology Service, Inc., of Kalamazoo, MI.

Alexander, L. E., "*X-Ray Diffraction Methods in Polymer Science*", Chapter 4, entitled Preferred Orientation in Polymers, published by R. E. Krieger Publishing Co., New York, 1979, see particularly, p. 241, Equation $4 \propto 21$.

*Primary Examiner*—James C. Cannon

*Attorney, Agent, or Firm*—Donald M. Sell; Walter N. Kirn; Roger R. Tamte

[57] ABSTRACT

Oriented microfibers and processes for making them are disclosed, together with blends of such microfibers with other fibers such as crimped staple fibers and non-oriented microfibers.

10 Claims, 11 Drawing Sheets

ORIENTED MELT-BLOWN FIBERS, PROCESSES FOR MAKING SUCH FIBERS, AND WEBS MADE FROM SUCH FIBERS

FIELD OF THE INVENTION

The present invention is directed to melt-blown fibrous webs, i.e., webs prepared by extruding molten fiber-forming material through orifices in a die into a high-velocity gaseous stream which impacts the extruded material and attenuates it into fibers, often of microfiber size averaging on the order of 10 micrometers or less.

BACKGROUND OF THE INVENTION

During the over twenty-year period that melt-blown fibers have come into wide commercial use there has always been a recognition that the tensile strength of melt-blown fibers was low, e.g., lower than that of fibers prepared in conventional melt-spinning processes (see the article "Melt-Blowing—A One-Step Web Process For New Nonwoven Products," by Robert R. Buntin and Dwight D. Lohkcamp, Volume 56, No. 4, April 1973, Tappi, Page 75, paragraph bridging columns 2 and 3). At least as late as 1981, the art generally doubted "that melt-blown webs, per se, will ever possess the strengths associated with conventional nonwoven webs produced by melt spinning in which fiber attenuation occurs below the polymer melting point bringing about crystalline orientation with resultant high fiber strength" (see the paper "Technical Developments In The Melt-Blowing Process And Its Applications In Absorbent Products" by Dr. W. John McCulloch and Dr. Robert A. VanBrederode presented at Insight '81, copyright Marketing/Technology Service, Inc., of Kalamazoo, Mich., page 18, under the heading "Strength").

The low strength of melt-blown fibers limited the utility of the fibers, and as a result there have been various attempts to combat this low strength. One such effort is taught in Prentice, U.S. Pat. No. 3,704,198, where a melt-blown web is "fuse-bonded," as by calendering or point-bonding, at least a portion of the web. Although web strength can be improved somewhat by calendering, fiber strength is left unaffected, and overall strength is still less than desired.

Other prior workers have suggested blending high-strength bicomponent fibers into melt-blown fibers prior to collection of the web, or lamination of the melt-blown web to a high strength substrate such as a spunbond web (see U.S. Pat. Nos. 4,041,203; 4,302,495; and 4,196,245). Such steps add costs and dilute the microfiber nature of the web, and are not satisfactory for many purposes.

McAmish et al, U.S. Pat. No. 4,622,259, is directed to melt-blown fibrous webs especially suitable for use as medical fabrics and said to have improved strength. These webs are prepared by introducing secondary air at high velocity at a point near where fiber-forming material is extruded from the melt-blowing die. As seen best in FIG. 2 of the patent, the secondary air is introduced from each side of the stream of melt-blown fibers that leaves the melt-blowing die, the secondary air being introduced on paths generally perpendicular to the stream of fibers. The secondary air merges with the primary air that impacted on the fiber-forming material and formed the fibers, and the secondary air is turned to travel more in a direction parallel to the path of the fibers. The merged primary and secondary air then carries the fibers to a collector. The patent states that by the use of such secondary air, fibers are formed that are longer than those formed by a conventional melt-blowing process and which exhibit less autogeneous bonding upon fiber collection; with the latter property, the patent states it has been noted that the individual fiber strength is higher. Strength is indicated to be dependent on the degree of molecular orientation and it is stated (column 9, lines 21–27) that the > high velocity secondary air employed in the present process is instrumental in increasing the time and distance over which the fibers are attenuated. The cooling effect of the secondary air enhances the probability that the molecular orientation of the fibers is not excessively relaxed on the deceleration of the fibers as they are collected on the screen.

Fabrics are formed from the collected web by embossing the webs or adding a chemical binder to the web, and the fabrics are reported to have higher strengths, e.g., a minimum grab tensile strength to weight ratio greater than 0.8 N per gram per square meter, and a minimum Elmendorf tear strength to weight ratio greater than 0.04 N per gram per square meter.

Even if the fibrous webs of U.S. Pat. No. 4,622,259 have increased strengths, those strengths are still less than should ultimately be obtainable from the polymers used in the webs. Fibers made from the same polymers as those of the webs taught in U.S. Pat. No. 4,622,259, but made by techniques other than the melt-blown techniques of the patent, have greater strengths than the strengths reported in the patents.

SUMMARY OF THE INVENTION

The present invention provides new melt-blown fibers and fibrous webs of greatly improved strength, comparable for the first time to the strength of fibers and webs prepared by conventional melt-spinning processes such as spunbond fibers and fibrous webs. The new melt-blown fibers have much greater orientation and crystallinity than previous melt-blown fibers, as a result of preparation by a new method which, in brief summary, comprises extruding fiber-forming material through the orifices of a die into a high-velocity gaseous stream where the extruded material is rapidly attenuated into fibers; directing the attenuated fibers into a first open end, i.e., the entrance end, of a tubular chamber disposed near the die and extending in a direction parallel to the path of the attenuated fibers as they leave the die; introducing air into the tubular chamber blowing along the axis of the chamber at a velocity sufficient to maintain the fibers under tension during travel through the chamber; and collecting the fibers after they leave the opposite, or exit end, of the tubular chamber.

Generally, the tubular chamber is a thin wide box-like chamber (generally somewhat wider than the width of the melt-blowing die). Air is generally brought to the chamber at an angle to the path of the extruded fibers but travels around a curved surface at the first open end of the chamber. By the Coanda effect, the air turns around the curved surface in a laminar, non-turbulent manner, thereby assuming the path traveled by the extruded fibers and merging with the primary air in which the fibers are entrained. The fibers are drawn into the chamber in an orderly compact stream and remain in that compact stream through the complete chamber Preferably, the tubular chamber is flared outwardly around the circumference of its exit end, which has been found to better provide isotropic properties in the collected or finished web.

The orienting air generally has a cooling effect on the fibers (the orienting air can be, but usually is not heated, but is ambient air at a temperature less than about 35° C.; in some circumstances, it may be useful to cool the orienting air below ambient temperature before it is introduced into the orienting chamber.) The cooling effect is generally desirable since it accelerates cooling and solidification of the fibers, whereupon the pulling effect of the orienting air as it travels through the orienting chamber provides a tension on the solidified fibers that tends to cause them to crystallize.

The significant increase in molecular orientation and crystallinity of the fibers of the invention over conventional melt-blown fibers is illustrated by reference to FIGS. 4, 7, 8, 10 and 11, which show WAXS (wide-angle x-ray scattering) photographs of fibers that, respectively, are oriented fibers of the invention (A photo) and are non-oriented conventional fibers of the prior art (B photo). The ring-like nature of the light areas in the B photos signifies that the pictured fibers of the invention are highly crystalline, and the interruption of the rings means that there is significant crystalline orientation.

DETAILED DESCRIPTION

Figure 1:
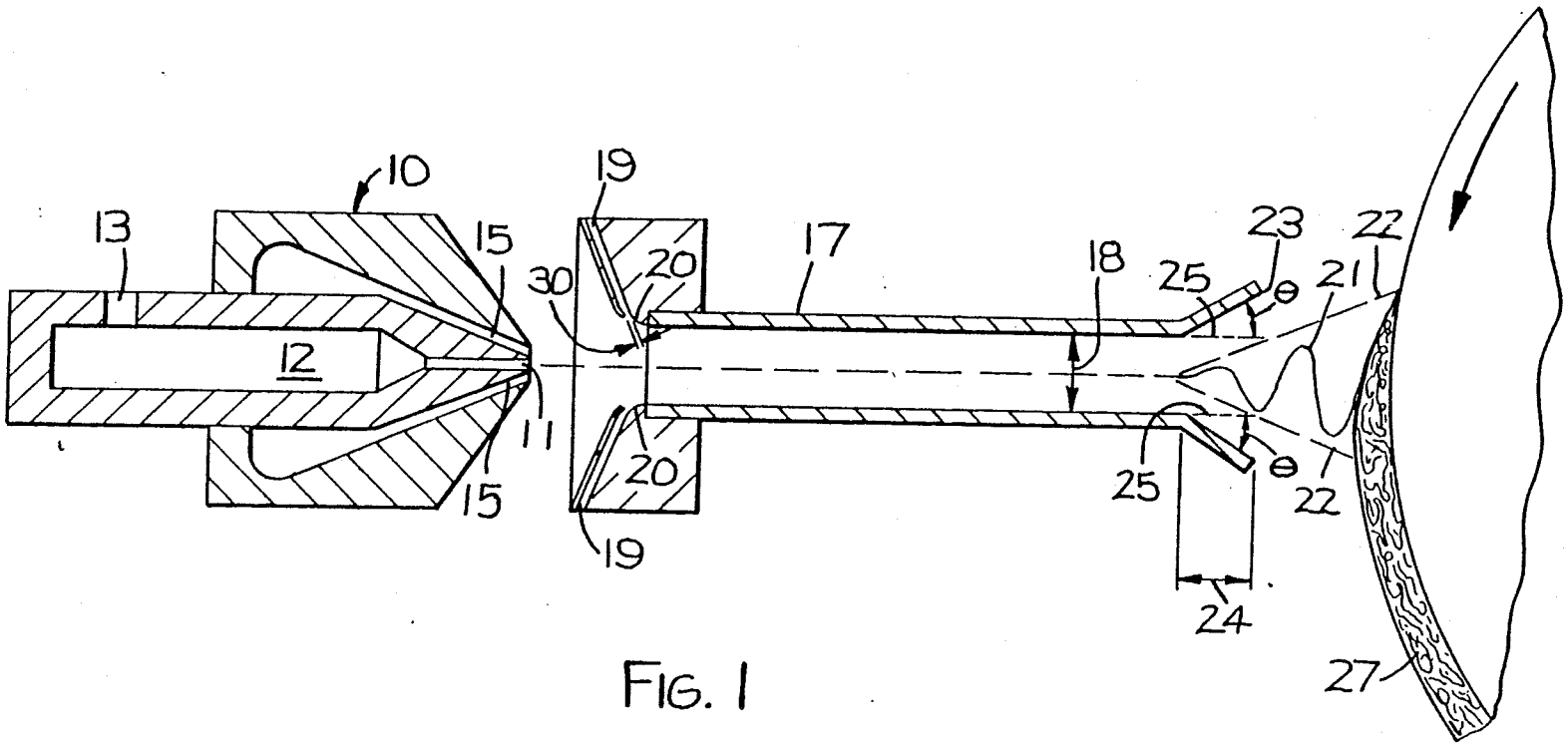

A representative apparatus useful for preparing blown fibers or a blown-fiber web of the invention is shown schematically in FIG. 1. Part of the apparatus, which forms the blown fibers, can be as described in Wente, Van A., "Superfine Thermoplastic Fibers" in *Industrial Engineering Chemistry*, vol 48, page 1342 et seq. (1956), or in Report No. 4364 of the Naval Research Laboratories, published May 25, 1954, entitled "Manufacture of Superfine Organic Fibers," by Wente, V. A.; Boone, C. D.; and Fluharty, E. L. This portion of the illustrated apparatus comprises a die 10 which has a set of aligned side-by-side parallel die orifices 11, one of which is seen in the sectional view through the die. The orifices 11 open from the central die cavity 12.

Fiber-forming material is introduced into the die cavity 12 through an opening 13 from an extruder (not illustrated). Orifices 15 disposed on either side of the row of orifices 11 convey heated air at a very high velocity. This air, called the primary air, impacts onto the extruded fiber-forming material, and rapidly draws out and attenuates the extruded material into a mass of fibers.

From the melt-blowing die 10, the fibers travel to a tubular orienting chamber 17. "Tubular" is used in this specification to mean any axially elongated structure having open ends at each axially opposed end, with walls surrounding the axis. Generally, the chamber is a rather thin, wide, box-like chamber, having a width somewhat greater than the width of the die 10, and a height (18 in FIG. 1) sufficient for the orienting air to flow smoothly through the chamber without undue loss of velocity, and for fibrous material extruded from the die to travel through the chamber without contacting the walls of the chamber. Too large a height would require unduly large volumes of air to maintain a tension-applying air velocity. Good results have been obtained with a height of about 10 millimeters or more, and we have found no need for a height greater than about 25 millimeters Orienting or secondary air is introduced into the orienting chamber through the orifices 19 arranged near the first open end of the chamber where fibers from the die enter the chamber. Air is preferably introduced from both sides of the chamber (i.e., from opposite sides of the stream of fibers entering the chamber) around curved surfaces 20, which may be called Coanda surfaces The orienting air introduced into the chamber bends as it travels around the Coanda surfaces and travels along the longitudinal axis of the chamber. The travel of the air is quite uniform and rapid and it draws into the chamber in a uniform manner the fibers extruded from the melt-blowing die 10. Whereas fibers exiting from a melt-blown die typically oscillate in a rather wide pattern soon after they leave the die, the fibers exiting from the melt-blowing die in the method of the invention tend to pass uniformly in a surprising planar-like distribution into the center of the chamber and travel lengthwise through the chamber. After they exit the chamber, they typically exhibit oscillating movement as represented by the oscillating line 21 and by the dotted lines 22 which represent the general outlines of the stream of fibers.

As shown in FIG. 1, the orienting chamber 17 is preferably flared at its exit end 23. This flaring has been found to cause the fibers to assume a more randomized or isotropic arrangement within the fiber stream. For example, whereas a collected web of fibers of the invention passed through a chamber which does not have a flared exit tends to have a machine-direction fiber pattern (i.e., more fibers tend to be aligned in a direction parallel to the direction of movement of the collector than are aligned transverse to that direction), webs of fibers collected from a chamber with a flared exit are more closely balanced in machine and transverse orientation The flaring can occur both in its height and width dimensions, i.e., in both the axis or plane of the drawing and in the plane perpendicular to the page of the drawings. More typically, the flaring occurs only in the axis in the plane of the drawing, i.e., in the large area sides or walls on opposite sides of the stream of fibers passing through the chamber Flaring at an angle (the angle $\theta$) between a broken line 25 parallel to the central or longitudinal axis of the chamber and the flared side of the chamber between about 4° and 7° is believed ideal to achieve smooth isotropic deposit of fibers. The length 24 of the portion of the chamber over which flaring occurs (which may be called the randomizing portion of the chamber) depends on the velocity of the orienting air and the diameter of fibers being produced. At lower velocities, and at smaller fiber diameters, shorter lengths are used. Flaring lengths between 25 and 75 centimeters have proven useful.

The orienting air enters the orienting chamber 17 at a high velocity sufficient to hold the fibers under tension as they travel lengthwise through the chamber. Planar continuous travel through the chamber is an indication that the fibers are under tension. The needed velocity of the air, which is determined by the pressure with which air is introduced into the orienting chamber and the dimensions of the orifices or gaps 19, varies with the kind of fiber-forming material being used and the diameter of the fibers For most situations, velocities corresponding to pressures of about 70 psi (approximately 500 kPa) with a gap width for the orifice 19 (the dimension 30 in FIG. 1) of 0.005 inch (0.013 cm), have been found optimum to assure adequate tension. However, pressures as low as 20 to 30 psi (140 to 200 kPa) have been used with some polymers, such as nylon 66, with the stated gap width.

Surprisingly, the fibers can travel through the chamber a long distance without contacting either the top or bottom surface of the chamber The chamber is generally at least about 40 centimeters long (shorter chambers can be used at lower production rates) and preferably is at least 100 centimeters long to achieve desired orientation and desired mechanical properties in the fibers With shorter chamber lengths, faster air velocities can be used to still achieve fiber orientation The entrance end of the chamber is generally within 5–10 centimeters of the die, and as previously indicated, despite the turbulence conventionally present near the exit of a melt-blowing die, the fibers are drawn into the orienting chamber in an organized manner.

After exiting from the orienting chamber 17, the solidified fibers are decelerating, and, in the course of that deceleration, they are collected on the collector 26 as a web 27. The collector may take the form of a finely perforated cylindrical screen or drum, or a moving belt. Gas-withdrawal apparatus may be positioned behind the collector to assist in deposition of fibers and removal of gas.

The collected web of fibers can be removed from the collector and wound in a storage roll, preferably with a liner separating adjacent windings on the roll. At the time of fiber collection and web formation, the fibers are totally solidified and oriented. These two features tend to cause the fibers to have a high modulus, and it is difficult to make high-modulus fibers decelerate and entangle to form a coherent web. Webs comprising only oriented melt-blown fibers may not have the coherency of a collected web of conventional melt-blown fibers. For that reason, the collected web of fibers is often fed directly to apparatus for forming an integral handleable web, e.g., by bonding the fibers together as by calendering the web uniformly in areas or points (generally in an area of about 5 to 40 percent), consolidating the web into a coherent structure by, e.g., hydraulic entanglement, ultrasonically bonding the web, adding a binder material to the fibers in solution or molten form and solidifying the binder material, adding a solvent to the web to solvent-bond the fibers together, or preparing bicomponent fibers and subjecting the web to conditions so that one component fuses, thereby fusing together adjacent or intersecting fibers. Also, the collected web may be deposited on another web, for example, a web traveling over the collector; also a second web may be applied over the uncovered surface of the collected web. The collected web may be unattached to the carrier or cover web or liner, or may be adhered to the web or liner as by heat-bonding or solvent-bonding or by bonding with an added binder material.

The blown fibers of the invention are preferably microfibers, averaging less than about 10 micrometers in diameter. Fibers of that size offer improved filtration efficiency and other beneficial properties. Very small fibers, averaging less than 5 or even 1 micrometer in diameter, may be blown, but larger fibers, e.g., averaging 25 micrometers or more in diameter, may also be blown, and are useful for certain purposes such as coarse filter webs.

The invention is of advantage in forming fibers of small fiber size, and fibers produced by the invention are generally smaller in diameter than fibers formed under the same melt-blowing conditions as used for fibers of the invention but without use of an orienting chamber as used in the invention. Also, the fibers have a narrow distribution of diameters. For example, in preferred samples of webs of the invention, the diameter of three-quarters or more of the fibers, ideally, 90 percent or more, have tended to lie within a range of about 3 micrometers, in contrast to a typically much larger spread of diameters in conventional melt-blown fibers.

The oriented melt-blown fibers of the invention are believed to be continuous, which is apparently a fundamental distinction from fibers formed in conventional melt-blowing processes, where the fibers are typically said to be discontinuous. The fibers generally travel through the orienting chamber without interruption, and no evidence of fiber ends is found in the collected web. For example, collected webs of the invention are remarkably free of shot (solidified globules of fiber-forming material such as occur when a fiber breaks and the release of tension permits the material to retract back into itself.) Also, the fibers show little if any thermal bonding between fibers.

Other fibers may be mixed into a fibrous web of the invention, e.g., by feeding the other fibers into the stream of blown fibers after it leaves the tubular chamber and before it reaches a collector. U.S. Pat. No. 4,118,531 teaches a process and apparatus for introducing into a stream of melt-blown fibers crimped staple fibers which increase the loft of the collected web, and such process and apparatus are useful with fibers of the present invention. U.S. Pat. No. 3,016,599 teaches such a process for introducing uncrimped fibers. The additional fibers can have the function of opening or loosening the web, of increasing the porosity of the web, and of providing a gradation of fiber diameters in the web.

Furthermore, added fibers can function to give the collected web coherency. For example, fusible fibers, preferably bicomponent fibers that have a component that fuses at a temperature lower than the fusion temperature of the other component, can be added and the fusible fibers can be fused at points of fiber intersection to form a coherent web. Also, it has been found that addition of crimped staple fibers to the web, such as described in U.S. Pat. No. 4,118,531, will produce a coherent web. The crimped fibers intertwine with one another and with the oriented fibers in such a way as to provide coherency and integrity to the web.

Webs comprising a blend of crimped fibers and oriented melt-blown fibers (e.g., comprising staple fibers in amounts up to about 90 volume percent, with the amount preferably being less than about 50 volume percent of the web) have a number of other advantages, especially for use as thermal insulation. First, the addition of crimped fibers makes the web more bulky or lofty, which enhances insulating properties. Further, the oriented melt-blown fibers tend to be of small diameter and to have a narrow distribution of fiber diameters, both of which can enhance the insulating quality of the web since they contribute to a large surface area per volume-unit of material. Another advantage is that the webs are softer and more drapable than webs comprising non-oriented melt blown microfibers, apparently because of the absence of thermal bonding between the collected fibers. At the same time, the webs are very durable because of the high strength of the oriented fibers, and because the oriented nature of the fiber makes it more resistant to high temperatures, dry cleaning solvents, and the like. The latter advantage is especially important with fibers of polyethylene terephthalate, which tends to be amorphous in character when made by conventional melt-blowing procedures. When subjected to higher temperatures the amorphous polyester polymer can crystallize to a brittle form, which is less durable during use of the fabric. But the oriented polyester fibers of the invention can be heated without a similar degradation of their properties.

It has also been found that lighter-weight webs of the invention can have equivalent insulating value as heavier webs made from non-oriented melt-blown fibers. One reason is that the smaller diameter of the fibers in a web of the invention, and the narrow distribution of fiber diameters, causes a larger effective fiber surface area in a web of the invention, and the larger surface area effectively holds more air in place, as discussed in U.S. Pat. No. 4,118,531. Larger surface area per unit weight is also achieved because of the absence of shot and "roping" (grouping of fibers such as occurs in conventional melt-blowing through entanglement or thermal bonding).

Figure 2:
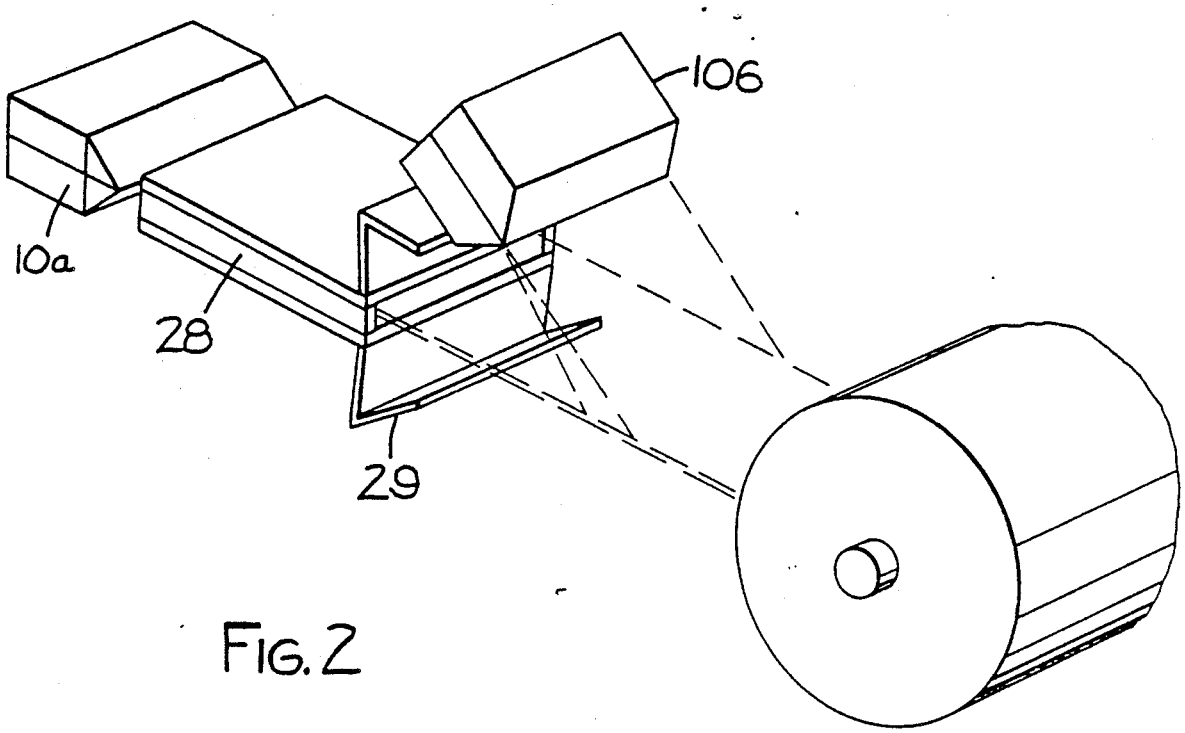

Coherent webs may also be prepared by mixing oriented melt-blown fibers with non-oriented melt-blown fibers. An apparatus for preparing such a mixed web is shown in FIG. 1 and comprises first and second melt-blowing dies 10*a* and 10*b* having the structure of the die 10 shown in FIG. 1, and an orienting chamber 28 through which fibers extruded from the first die 10*a* pass. The chamber 28 is like the chamber 17 shown in FIG. 1, except that the randomizing portion 29 at the end of the orienting chamber has a different flaring than does the randomizing portion 24 shown in FIG. 1. In the apparatus of FIG. 2, the chamber flares rapidly to an enlarged height, and then narrows slightly until it reaches the exit. While such a chamber provides an improved isotropic character to the web, the more gradual flaring of the chamber shown in FIG. 1 provides a more isotropic character.

Polymer introduced into the second die 10*b* is extruded through a set of orifices and formed into fibers in the same way as fibers formed by the first die 10*a*, but the prepared fibers are introduced directly into the stream of fibers leaving the orienting chamber 28. The proportion of oriented to non-oriented fibers can be varied greatly and the nature of the fibers (e.g., diameter, fiber composition, bicomponent nature) can be varied as desired. Webs can be prepared that have a good isotropic balance of properties, e.g., in which the cross-direction tensile strength of the web is at least about three-fourths of the machine-direction tensile strength of the web.

Some webs of the invention include particulate matter, which may be introduced into the web in the manner disclosed in U.S. Pat. No. 3,971,373, e.g., to provide enhanced filtration. The added particles may or may not be bonded to the fibers, e.g., by controlling process condition during web formation or by later heat treatments or molding operations. Also, the added particulate matter can be a supersorbent material such as taught in U.S. Pat. 4,429,001.

The fibers may be formed from a wide variety of fiber-forming materials. Representative polymers for forming melt-blown fibers include polypropylene, polyethylene, polyethylene terephthalate, and polyamide. Nylon 6 and nylon 66 are especially useful materials because they form fibers of very high strength.

Fibers of the invention may be made in bicomponent form, e.g., with a first polymeric material extending longitudinally along the fiber through a first cross-sectional area of the fiber and a second polymeric material extending longitudinally through a second portion of the cross-sectional area of the fiber. Dies and processes for forming such fibers are taught in U.S. Pat. No. 4,547,420, which is incorporated herein by reference. The fibers may be formed from a wide variety of fiber-forming materials, with representative combinations of components including: polyethylene terephthalate and polypropylene; polyethylene and polypropylene; polyethylene terephthalate and linear polyamides such as nylon 6; polybutylene and polypropylene; and polystyrene and polypropylene. Also, different materials may be blended to serve as the fiber-forming material of a single-component fiber or to serve as one component of a bicomponent fiber.

Fibers and webs of the invention may be electrically charged to enhance their filtration capabilities, as by introducing charges into the fibers as they are formed, in the manner described in U.S. Pat. No. 4,215,682, or by charging the web after formation in the manner described in U.S. Pat. No. 3,571,679; see also U.S. Pat. Nos. 4,375,718, 4,588,537, and 4,592,815. Polyolefins, and especially polypropylene, are desirably included as a component in electrically charged fibers of the invention because they retain a charged condition well.

Fibrous webs of the invention may include other ingredients in addition to the microfibers. For example, fiber finishes may be sprayed onto a web to improve the hand and feel of the web. Additives, such as dyes, pigments, fillers, surfactants, abrasive particles, light stabilizers, fire retardants, absorbents, medicaments, etc., may also be added to webs of the invention by introducing them to the fiber-forming liquid of the microfibers, or by spraying them on the fibers as they are formed or after the web has been collected.

A completed web of the invention may vary widely in thickness. For most uses, webs have a thickness between about 0.05 and 5.0 centimeters. For some applications, two or more separately formed webs may be assembled as one thicker sheet product.

The invention will be further described by reference to the following illustrative examples.

EXAMPLE 1

Using the apparatus of FIG. 2, minus the second die 10*b* oriented microfibers were made from polypropylene resin (Himont PF 442, supplied by Himont Corp., Wilmington, Del., having a melt-flow index (MFI) of 800–1000). The die temperature was 200° C. and the primary air temperature was 190° C. The primary air pressure was 10 psi (70 kPa), with gap width in the orifices 15 being between 0.015 and 0.018 inch (0.038 and 0.046 cm). The polymer was extruded through the die orifices at a rate of about 0.009 pound per hour per orifice (89 g/hr/orifice).

From the die the fibers were drawn through a box-like tubular orienting chamber as shown in FIG. 2 having an interior height of 0.5 inch (1.3 cm), an interior width of 24 inches (61 cm), and a length of 18 inches (46 cm). The randomizing or expansion portion 29 of the chamber was 24 inches (61 cm) long, and as illustrated in the drawing, was formed by portions of the large-area walls defining the orienting chamber, which flared at 90° to the portions of the walls defining the main portion 28 of the chamber; the wall flared to a 6 inch (15.24 cm) height at the point of their connection to the main portion of the chamber, and then narrowed to a 5 inch (12.7 cm) height over its 24 inch (61 cm) length. Secondary air having a temperature of about 25° C. was blown into the orienting chamber at a pressure of 70 psi (483 kPa) through orifices (like the orifices 19 shown in FIG. 1) having a gap width of 0.005 inch (0.013 cm).

The completed fibers exited the chamber at a velocity of about 5644 meters/minute and were collected on a screen-type collector spaced about 36 inches (91 cm) from the die and moving at a rate of about 5 meters per minute. The fibers ranged in diameter between 1.8 and 5.45 microns and had an average diameter of about 4 microns. The speed draw ratio for the fibers (the ratio of exit velocity to initial extrusion velocity) was 11,288 and the dimeter draw ratio was 106.

Figure 3A:
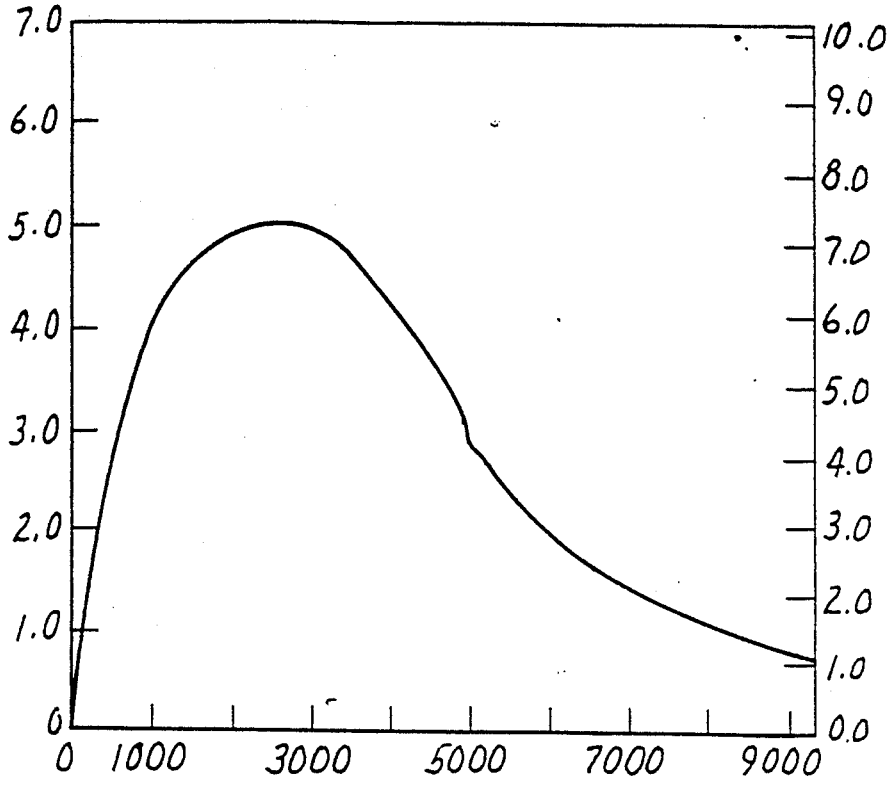

The tensile strength of the fibers was measured by testing a collected embossed web of the fibers (embossed over about 34 percent of its area with 0.54-square-millimeter-sized diamond-shaped spots) with an Instron tensile testing machine. The test was performed using a gauge length, i.e., a separation of the jaws, of as close to zero as possible, approximately 0.009 centimeter. Results are shown in FIG. 3A. Stress is plotted in dynes/cm$^2\times10^7$ on the ordinate and nominal strain in percent on the abscissa (stress is plotted in psi$\times10^2$ on the right-hand ordinate). Young's modulus was $4.47\times10^6$ dynes/cm$^2$, break stress was $4.99\times10^7$ dynes/cm$^2$ and toughness (the area under the curve) was $2.69\times10^9$ ergs/cm$^3$. By using a very small spacing between jaws of the tensile testing machine, the measured values reflect the values on average for individual fibers, and avoid the effect of the embossing. The sample tested was 2 centimeters wide and the crosshead rate was 2 cm/minute.

Figure 3B:
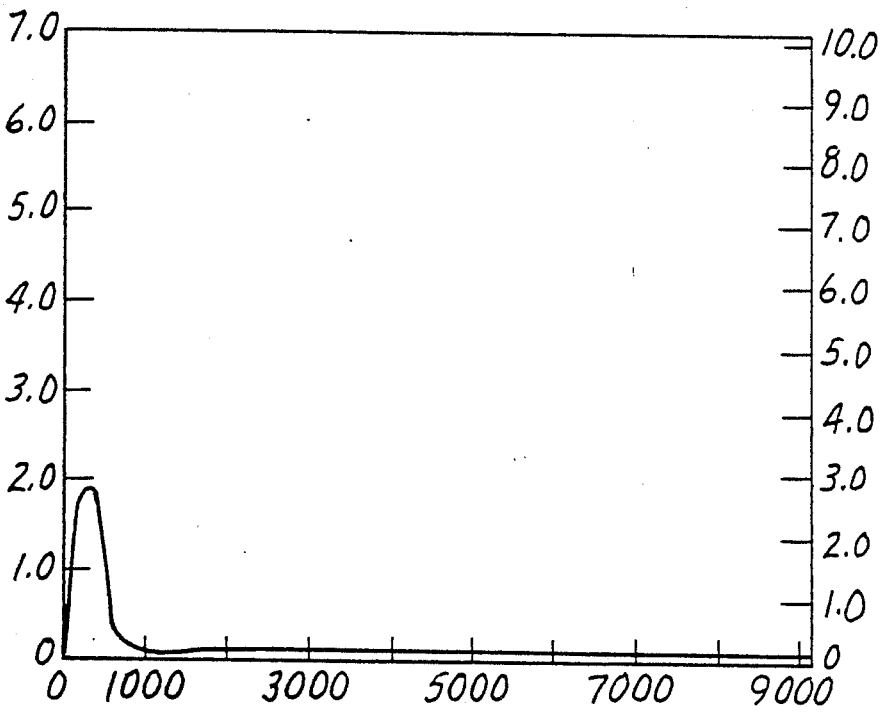

For comparative purposes, tests were also performed on microfibers like those of this example, i.e., prepared from the same polypropylene resin and using the same apparatus, except that they were not passed through the orienting chamber. These comparative fibers ranged in diameter between 3.64 and 12.73 microns in diameter, and had a mean diameter of 6.65 microns The stress-strain curve is shown in FIG. 3B. Young's modulus was $1.26\times10^6$ dynes/cm$^2$, break stress was $1.94\times10^7$ dynes/cm$^2$, and toughness was $8.30\times10^8$ ergs/cm$^3$. It can be seen that the more oriented microfibers produced by the process of the present invention had higher values in these properties by between 250 and over 300% than the microfibers prepared in the conventional process.

Figure 4A:
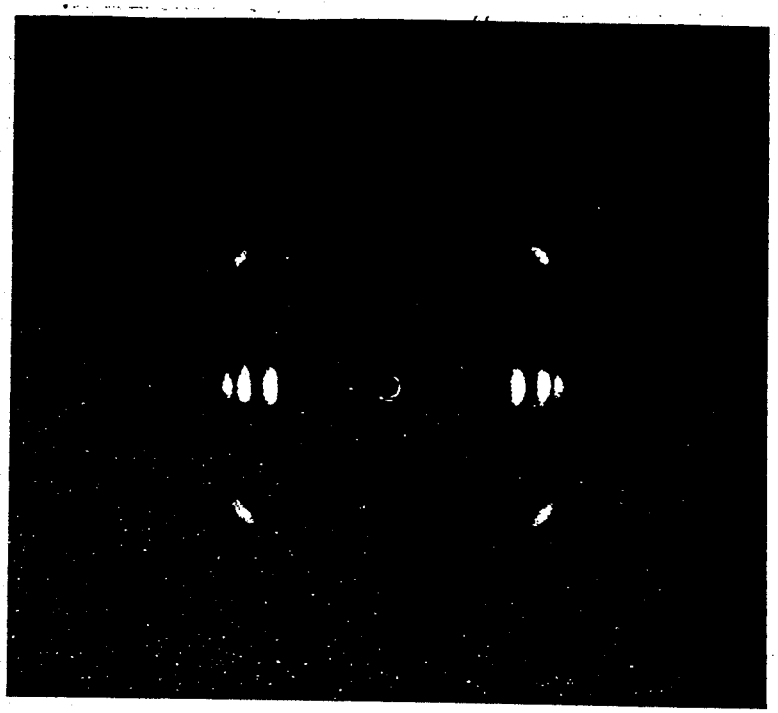
Figure 4B:
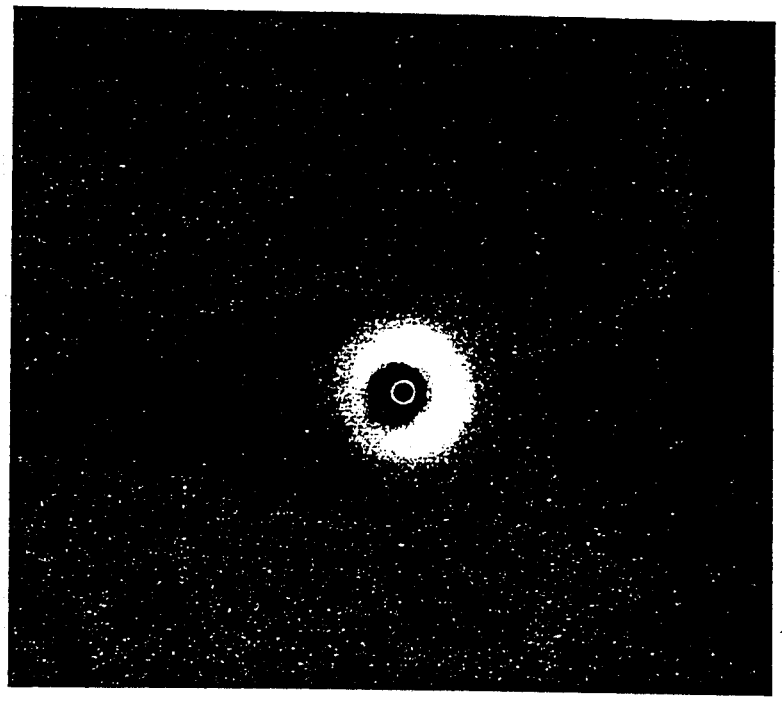

WAXS (wide angle x-ray scattering) photographs were prepared for the oriented fibers of the invention and the comparative unoriented fibers, and are pictured in FIG. 4A (fibers of the invention) and 4B (comparative fibers) (as is well understood in preparation of WAXS photographs of fibers, the photo is taken of a bundle of fibers such as obtained by collecting such a bundle on a rotating mandrel placed in the fiber stream exiting from the orienting chamber, or by cutting fiber lengths from a collected web and assembling the cut lengths into a bundle). The crystalline orientation of the oriented microfibers is readily apparent from the presence of rings, and the interruption of those rings in FIG. 4A.

Crystalline axial orientation function (orientation along the fiber axis) was also determined for the fibers of the invention (using procedures as described in Alexander, L. E., *X-Ray Diffraction Methods in Polymer Science*, Chapter 4, published by R. E. Krieger Publishing Co., New York, 1979; see particularly, page 241, Equation 4–21) and found to be 0.65. This value would be very low, at least approaching zero, for conventional melt-blown fibers. A value of 0.5 shows the presence of significant crystalline orientation, and preferred fibers of the invention exhibit values of 0.8 or higher.

EXAMPLE 2

Oriented nylon 6 microfibers were prepared using apparatus generally like that of Example 1, except that the main portion of the orienting chamber was 48 inches (122 cm) long. The melt-blowing die had circular smooth-surfaced orifices (25/inch) having a 5:1 length-to-diameter ratio. The die temperature was 270° C., the primary air temperature and pressure were, respectively, 270° C. and 15 psi (104 kPa), (0.020-inch [0.05 cm] gap width), and the polymer throughput rate was 0.5 lb/hr/in (89 g/hr/cm). The extruded fibers were oriented using air in the orienting chamber at a pressure of 70 psi (483 kPa) with a gap width of 0.005 inch (0.013 cm), and an approximate air temperature of 25° C. The flared randomizing portion of the orienting chamber was 24 inches (61 cm) long. Fiber exit velocity was about 6250 meters/minute.

Scanning electron microscopy (SEM) of a representative sample showed fiber diameters of 1.8 to 9.52 microns, with a calculated mean fiber diameter of 5.1 microns.

For comparison, an unoriented nylon 6 web was prepared without use of the orienting chamber and with a higher die temperature of 315° C. chosen to produce fibers similar in diameter to those of the oriented fibers of the invention (higher die temperature lowers the viscosity of the extruded material, which tends to result in a lower diameter of the prepared fibers; thereby the comparative fibers can approach the size of fibers of the invention, which as noted above, tend to be narrower in diameter than conventionally prepared melt-blown fibers). The fiber diameter distribution was measured as 0.3 to 10.5 microns, with a calculated mean fiber diameter of 3.1 microns.

Figure 5A:
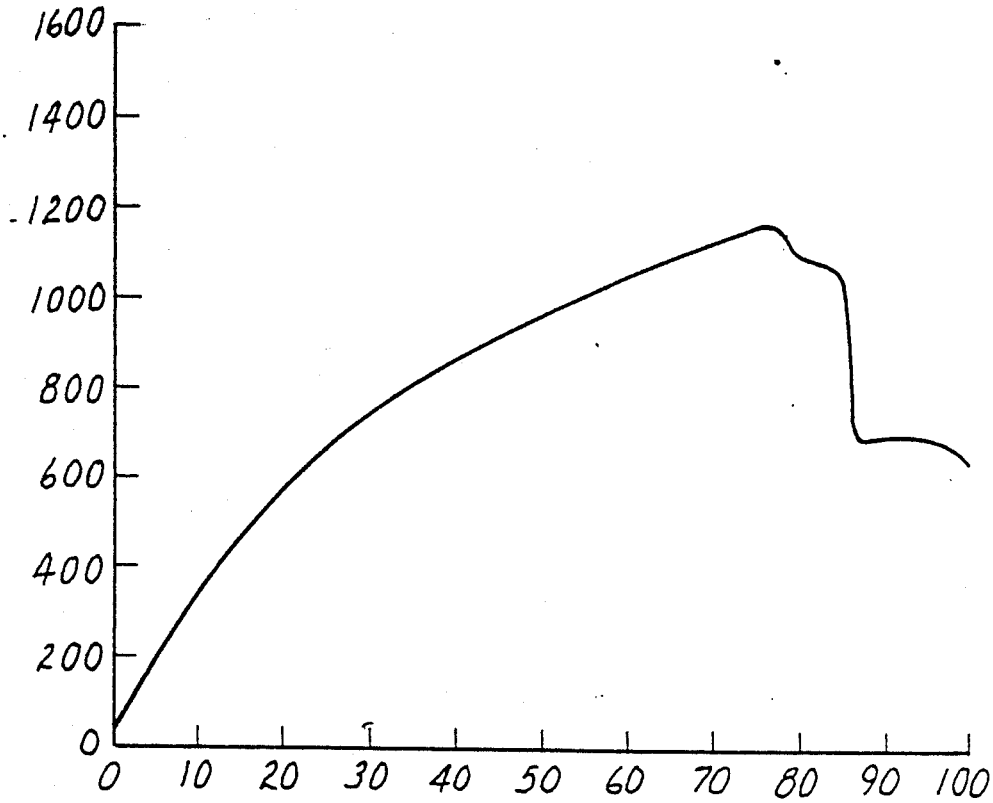
Figure 5B:
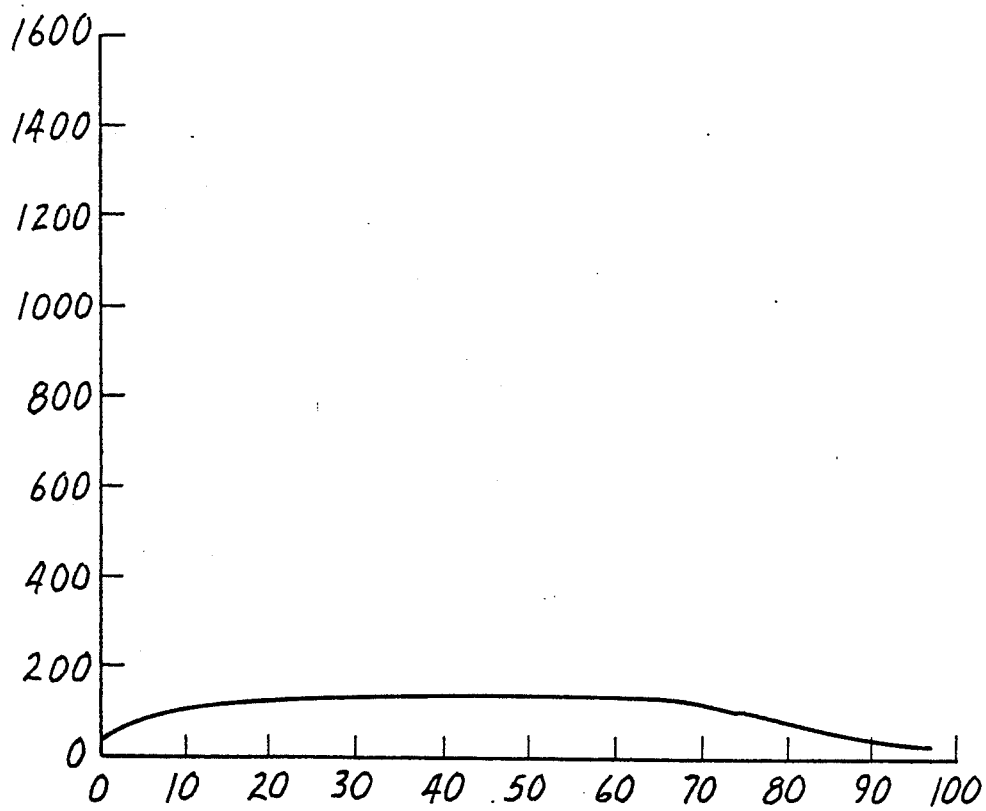

The tensile strength of the prepared fibers was measured as described in Example 1, and the resultant stress-strain curves are shown in FIG. 5A (fibers of the invention) and 5B (comparative unoriented fibers). Units on the ordinate are in pounds/square inch and on the abscissa are in percent.

Figure 6A:
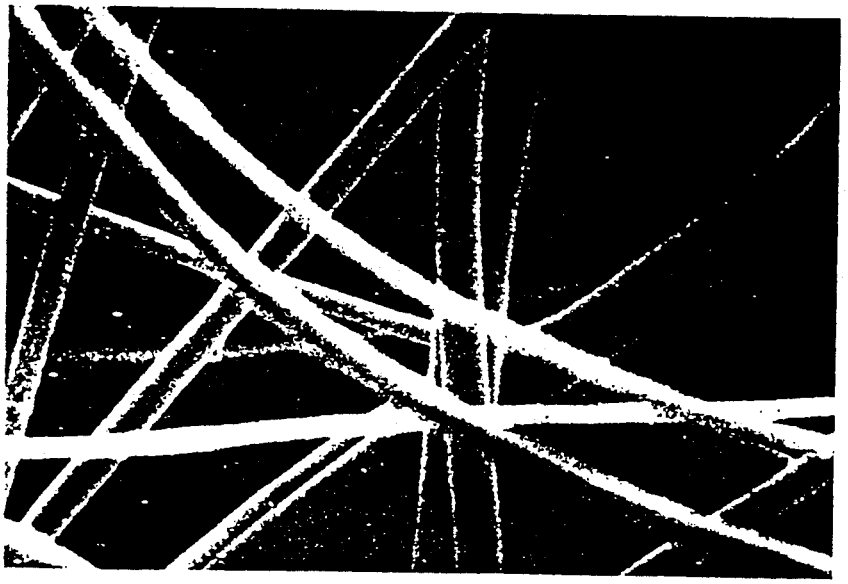
Figure 6B:
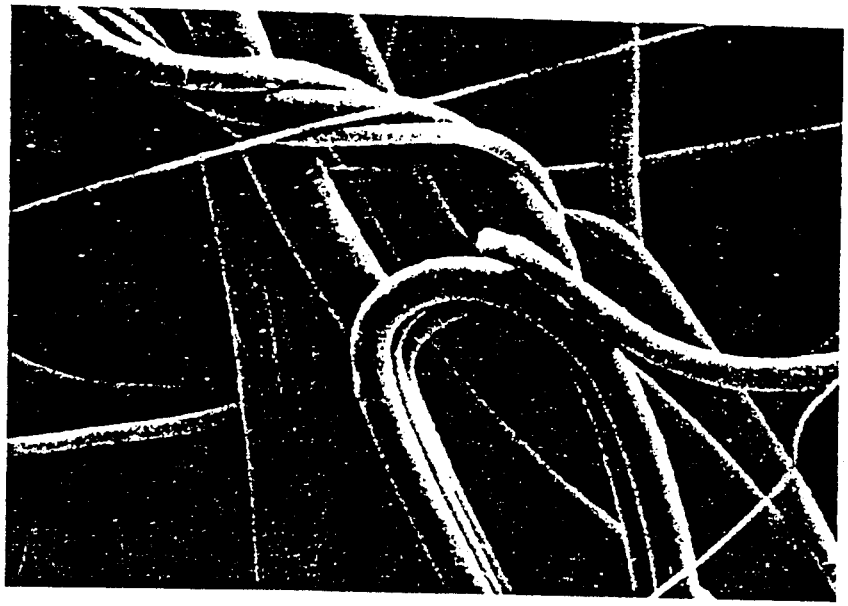

FIG. 6 presents SEM photographs of representative webs of the invention prepared as described above (6A) and of the comparative unoriented webs (6B) to further illustrate the difference between them as to fiber diameter. As will be seen, the comparative web includes very small-diameter fibers, apparently produced as a result of the great turbulence at the exit of a melt-blowing die in the conventional melt-blowing process. A much more uniform air flow occurs at the exit of the die in a process of the present invention, and this appears to contribute toward preparation of fibers that are more uniform in diameter.

Figure 7A:
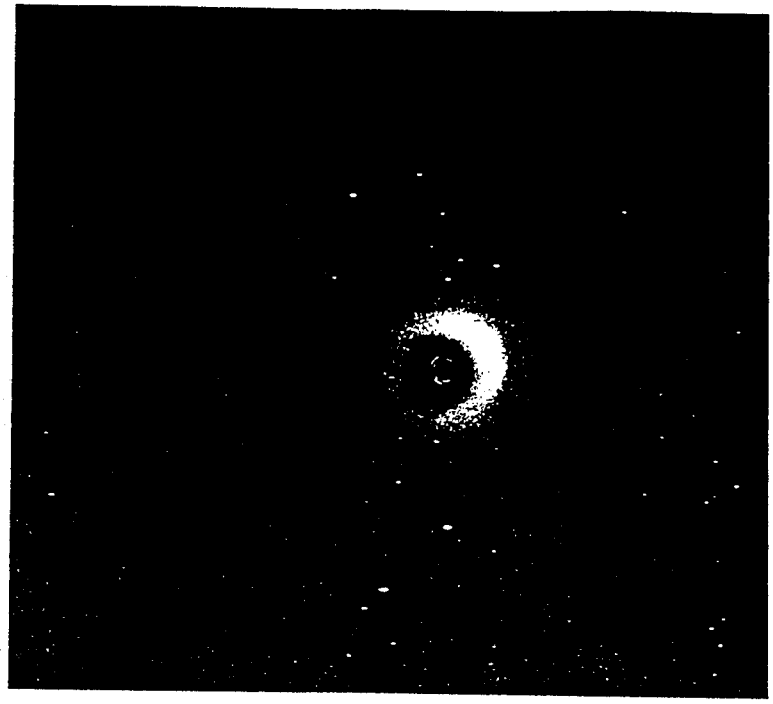
Figure 7B:
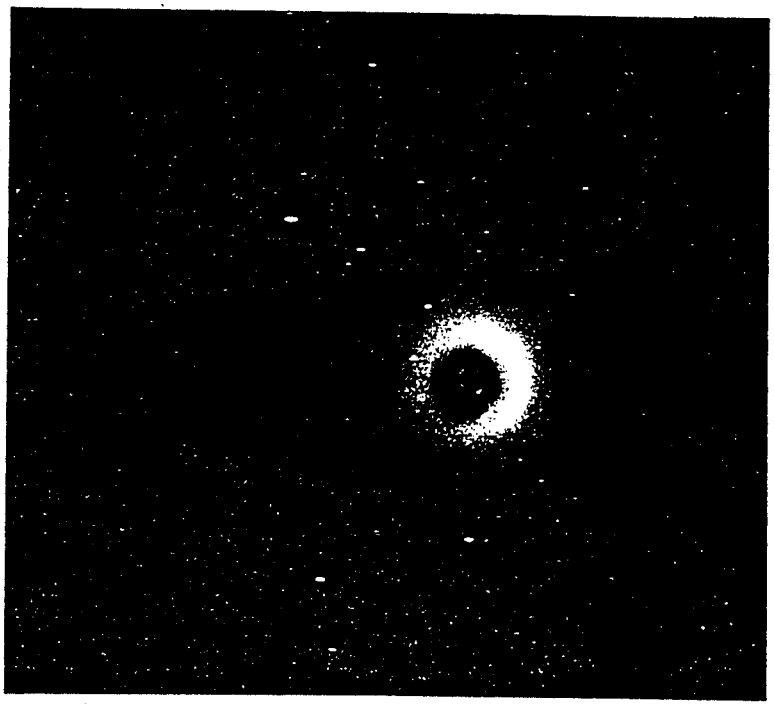

FIG. 7 presents WAXS photos for the fibers of the invention (7A) and the comparative fibers (7B).

EXAMPLE 3

Oriented microfibers of polyethylene terephthalate (Eastman A150 from Eastman Chemical Co.) were prepared using the apparatus and conditions of Example 2, except that the die temperature was 315° C., and the primary air pressure and temperature were, respectively, 20 psi (138 kPa) and 315° C. Fiber exit velocity was about 6000 meters/minute. The distribution of fiber diameters measured by SEM was 3.18 to 7.73 microns, with a mean of 4.94 microns.

Unoriented microfibers were prepared for comparative purposes, using the same resin and operating conditions except for a slightly higher die temperature (335° C.) and the lack of the orienting chamber. The fiber diameter distribution was 0.91 to 8.8 microns with a mean of 3.81 microns.

Figure 8A:
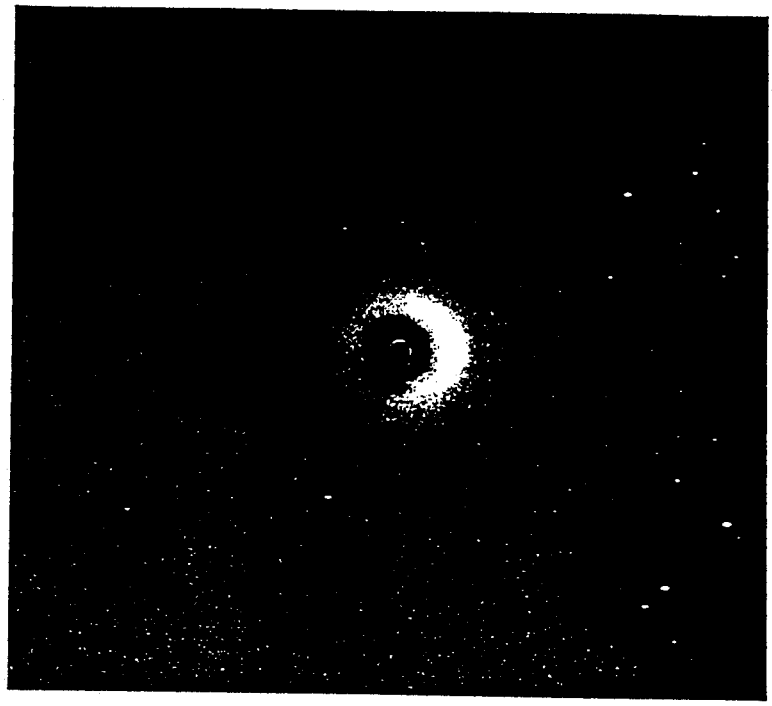
Figure 8B:
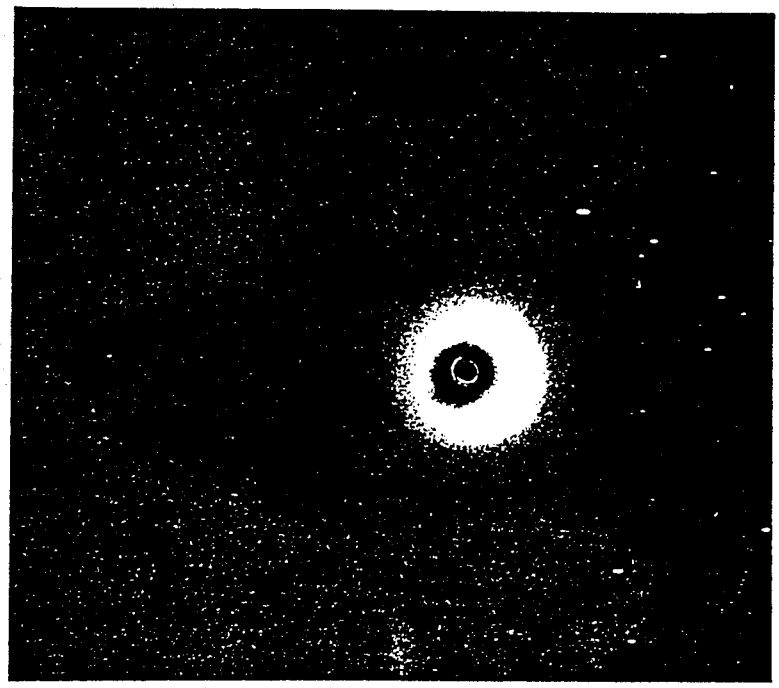

FIG. 8 shows the WAXS patterns photographed for the oriented (FIG. 8A) and comparative unoriented fibers (FIG. 8B). The increased crystalline orientation of the oriented microfibers was readily apparent.

EXAMPLES 4–6

Oriented microfibers were prepared from three different polypropylenes, having melt flow indices (MFI) respectively of 400–600 (Example 4), 600–800 (Example 5), and 800–1000 (Example 6). The apparatus of Example 2 was used, with a die temperature of 185° C., and a primary air pressure and temperature of 200° C. and 20 psi (138 kPa), respectively. Fiber exit velocity was about 9028 meters/minute. The 400–600-MFI microfibers prepared were found by SEM to range in diameter between 3.8 and 6.7 microns, with a mean diameter of 4.9 microns.

Figure 9A:
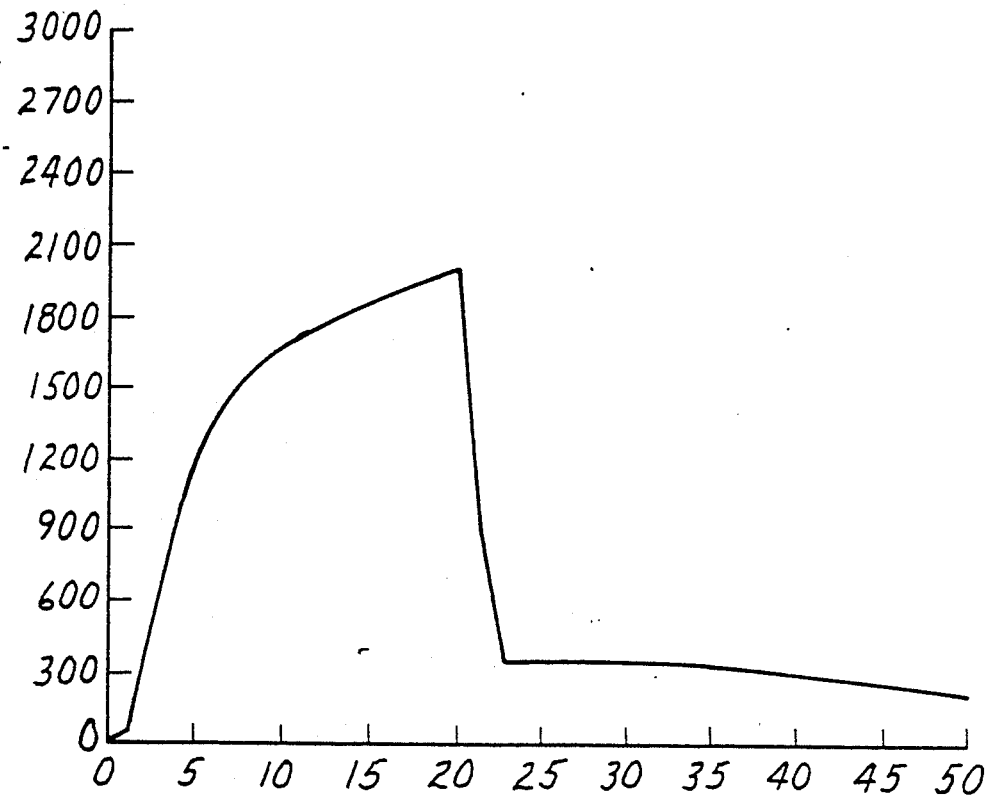
Figure 9B:
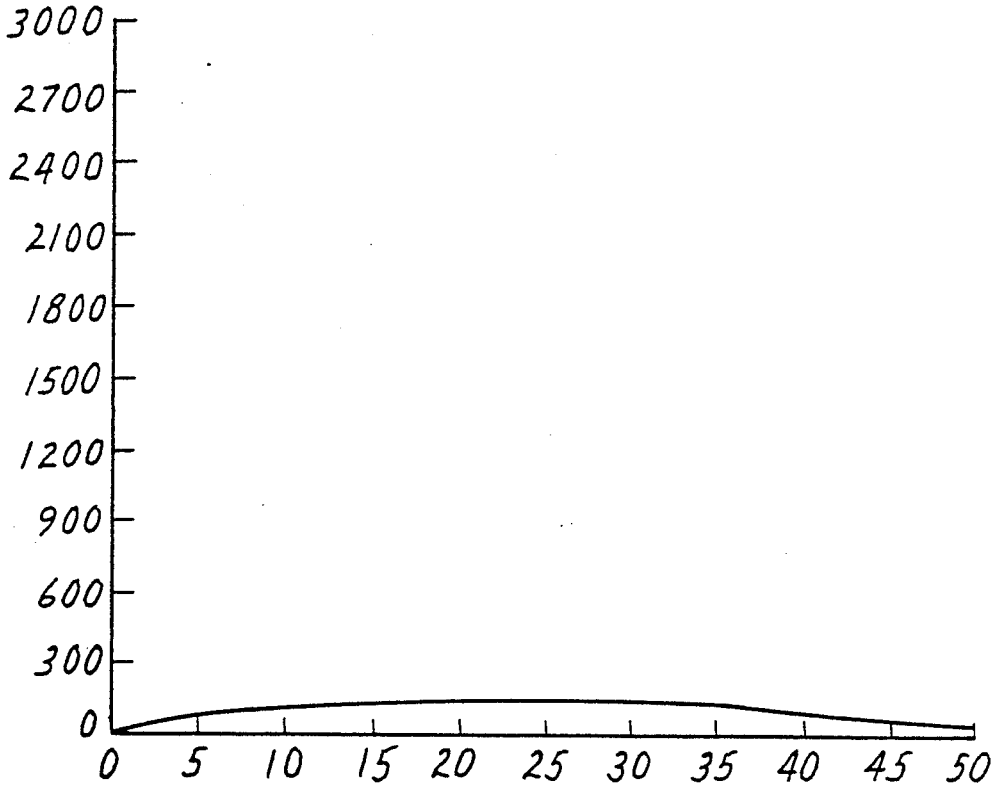
Figure 10A:
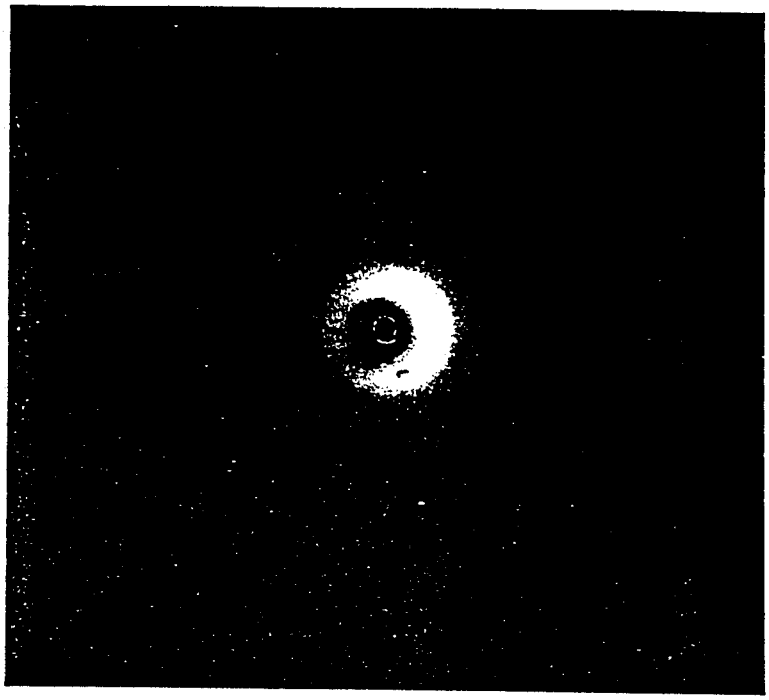
Figure 10B:
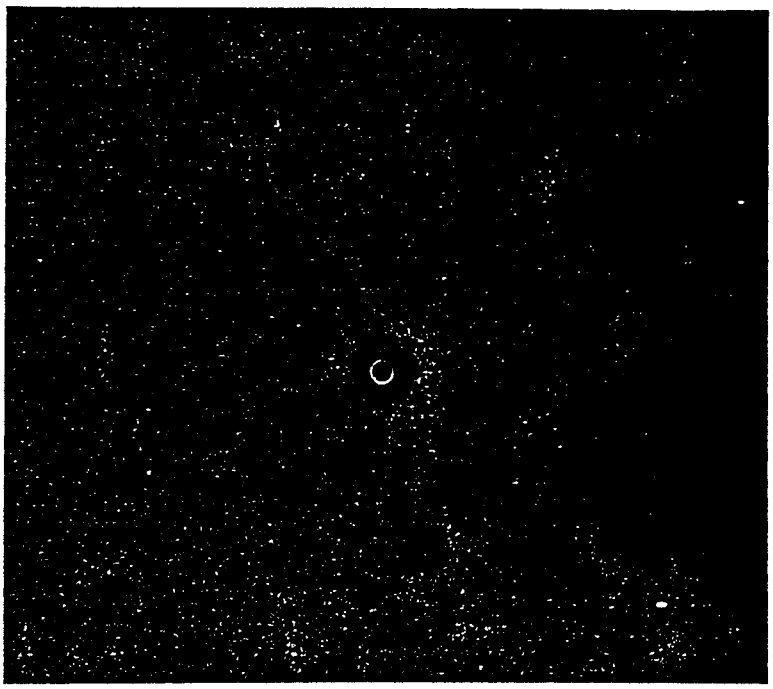
Figure 11A:
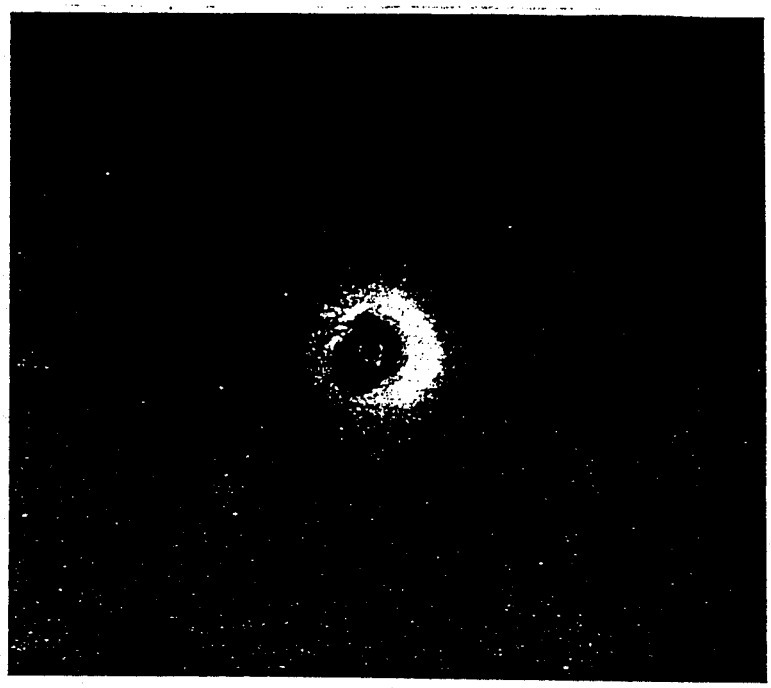
Figure 11B:
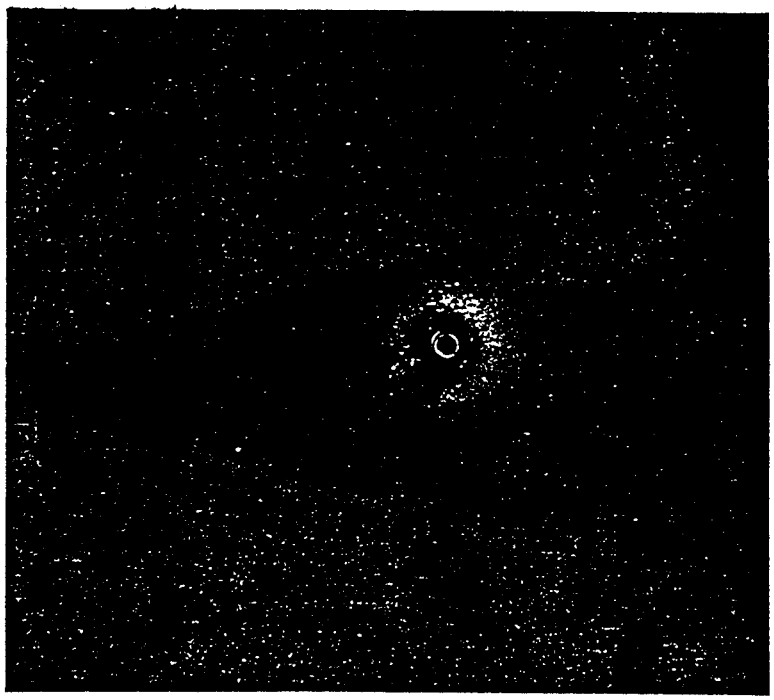

The tensile strength of the prepared 800–1000-MFI microfibers was measured using an Instron tester, and the stress-strain curves are shown in FIG. 9A (fibers of the invention) and 9B (comparative unoriented fibers).

Unoriented microfibers were prepared for comparative purposes, using the same resins and operating conditions except for use of higher die temperature and the absence of an orienting chamber. The prepared 400–600-MFI fibers ranged from 4.55 to 10 microns in diameter, with a mean of 6.86 microns.

EXAMPLE 7

Oriented microfibers were prepared from polyethylene terephthalate (251° C. melting point, crystallizes at 65°–70° C.) using the apparatus of Example 2, with a die temperature of 325° C., primary air pressure and temperature of 325° C. and 20 psi (138 kPa), respectively, and polymer throughput of 1 lb/hr/in (178 g/hr/cm). Fiber exit velocity was 4428 meters/minute. The fibers prepared ranged in diameter between 2.86 and 9.05 microns, with a mean diameter of 7.9 microns.

Comparative oriented microfibers were also prepared, using the same resins and operating conditions except for a higher die temperature and the absence of an orienting chamber. These fibers ranged in diameter between 3.18 and 14.55 microns and had an average diameter of 8.3 microns.

EXAMPLES 8–12

Webs were prepared on the apparatus of Example 2, except that the randomizing portion of the orienting chamber was flared in the manner pictured in FIG. 1 and was 20 inches (51 cm) long. Only the two wide walls of the chamber were flared, and the angle $\theta$ of flaring was 6°. Conditions were as described in Table I below. In addition, comparative webs were prepared from the same polymeric materials, but without passing the fibers through an orienting chamber; conditions for the comparative webs are also given in Table I (under the label "C"). Additional examples (11X and 12X) were also prepared using conditions like those described in Examples 11 and 12, except that the flared randomizing portion of the orienting chamber was 24 inches (61 centimeters) long. The webs were embossed with star patterns (a central dot and six line-shaped segments radiating from the dot), with the embossing covering 15 percent of the area of the web, and being prepared by passing the web under an embossing roller at a rate of 18 feet per minute, and using embossing temperatures as shown in Table I and a pressure of 20 psi (138 kPa). Both the webs of the invention and the comparative webs were tested for grab tensile strength and strip tensile strength (procedures described in ASTM D 1117 and D 1682) in both the machine direction (MD)—the direction the collector rotates—and the transverse or cross direction (TD), and results are given in Tables II and III. Elmendorf tear strength (ASTM D 1424) was also measured on some samples, and is reported in Table IV.

TABLE I

| | Example No. | | | | | | | | | |
|---|---|---|---|---|---|---|---|---|---|---|
| | 8 | 8C | 9 | 9C | 10 | 10C | 11 | 11C | 12 | 12C |
| Polymer | Polypropylene | | Nylon 6 | | Nylon 66 | | Polyethylene Terephthalate | | Polybutylene Terephthalate | |
| Die Temperature (°C.) | 190 | 275 | 275 | 300 | 300 | 300 | 300 | 325 | 260 | 300 |
| Primary Air | | | | | | | | | | |
| Pressure (psi) | 10 | 30 | 15 | 30 | 15 | 30 | 15 | 30 | 15 | 30 |
| (kPa) | 69 | 206 | 103 | 206 | 103 | 206 | 103 | 206 | 103 | 206 |
| Temperature (°C.) | 190 | 275 | 275 | 275 | 300 | 300 | 280 | 280 | 260 | 280 |
| Orienting Chamber | | | | | | | | | | |
| Pressure (psi) | 70 | | 75 | | 50 | | 70 | | 70 | |
| (kPa) | 483 | | 516 | | 344 | | 483 | | 483 | |
| Temperature (°C.) | ambient | | ambient | | ambient | | ambient | | ambient | |
| Polymer Throughput Per Inch Width | | | | | | | | | | |
| (lb/hr/in) | 0.5 | | 0.5 | | 1 | 1 | 1 | 1 | 1 | 1 |
| (kg/hr/cm) | 0.089 | | 0.089 | | 0.178 | 0.178 | 0.178 | 0.178 | 0.178 | 0.178 |
| Embossing Temperature (°C.) | 149 | 104 | 200 | 135 | 220 | 220 | 218 | 110 | 204 | 188 |

TABLE II

| | Grab Tensile Strength | | | | | | | | |
|---|---|---|---|---|---|---|---|---|---|
| | Machine Direction | | | | Cross Direction | | | | |
| Example No. | Load (lb) | Load (N) | Specific Strength ($N/g/m^2$) | % Elongation | Load (lb) | Load (N) | Specific Strength ($N/g/m^2$) | % Elongation | Basis Weight ($g/m^2$) |
| 8 | 25.81 | 114.81 | 2.09 | 59.40 | 22.51 | 100.13 | 1.82 | 64.80 | 55 |
| 8C | 8.45 | 37.59 | 0.696 | 106.40 | 8.07 | 35.90 | 0.665 | 104.00 | 54 |
| 9 | 28.67 | 127.53 | 2.50 | 77.20 | 23.06 | 102.58 | 2.01 | 94.20 | 51 |
| 9C | 9.03 | 40.17 | 0.772 | 187.40 | 6.18 | 27.49 | 0.529 | 132.40 | 52 |
| 10 | 41.78 | 185.85 | 4.13 | 97.80 | 18.02 | 80.16 | 1.78 | 103.80 | 45 |
| 10C | 16.49 | 73.35 | 1.36 | 132.20 | 9.50 | 42.26 | 0.782 | 122.60 | 54 |
| 11 | 45.02 | 200.26 | 4.01 | 136.00 | 32.38 | 144.03 | 2.88 | 126.00 | 50 |
| 11C | 13.24 | 58.89 | 1.20 | 275.60 | 9.36 | 41.64 | 0.850 | 250.40 | 49 |
| 12 | 23.19 | 103.15 | 1.84 | 172.60 | 17.24 | 76.69 | 1.37 | 181.60 | 56 |
| 12C | 12.49 | 55.56 | 1.05 | 248.20 | 10.25 | 45.59 | 0.860 | 203.20 | 53 |
| 12X | 10.64 | 47.33 | 0.876 | 274.60 | 17.63 | 78.42 | 1.45 | 237.80 | 54 |

TABLE III

| | | | Strip Tensile Strength | | | | | | | | |
|---|---|---|---|---|---|---|---|---|---|---|---|
| | | | Machine Direction | | | | Cross Direction | | | | |
| Example No. | Jaw Grip (In.) | Jaw Grip (cm) | Load (lb) | Load (N) | Specific Strength ($N/g/m^2$) | % Elongation | Load (lb) | Load (N) | Specific Strength ($N/g/m^2$) | % Elongation | Basis Weight ($g/m^2$) |
| 8 | 3 | 7.6 | 11.44 | 50.89 | 0.925 | 68.50 | 10.1 | 44.92 | 0.817 | 57.80 | 55 |
| | 1 | 2.5 | 10.58 | 47.06 | 0.856 | 24.40 | 9.22 | 41.01 | 0.746 | 21.60 | |
| | 0 | 0 | 12.64 | 56.23 | 1.022 | 29.00 | | | | | |
| 8C | 3 | 7.6 | 2.78 | 12.37 | 0.229 | 65.40 | 2.60 | 11.57 | 0.214 | 73.80 | 54 |
| | 1 | 2.5 | 3.00 | 13.34 | 0.247 | 20.80 | 2.71 | 12.05 | 0.223 | 24.60 | |
| | 0 | 0 | 3.83 | 17.04 | 0.315 | 20.60 | | | | | |
| 9 | 3 | 7.6 | 12.17 | 54.13 | 0.942 | 36.40 | 10.35 | 46.04 | 0.903 | 40.80 | 51 |
| | 1 | 2.5 | 12.63 | 58.18 | 1.10 | 12.60 | 14.15 | 62.94 | 1.23 | 16.40 | |
| | 0 | 0 | 18.35 | 81.62 | 1.60 | 9.00 | | | | | |
| 9C | 3 | 7.6 | 3.03 | 13.48 | 0.259 | 87.80 | 1.88 | 8.36 | 0.161 | 79.00 | 52 |
| | 1 | 2.5 | 3.44 | 15.30 | 0.294 | 31.40 | 2.05 | 9.12 | 0.175 | 41.17 | |
| | 0 | 0 | 4.21 | 18.73 | 0.360 | 29.8 | | | | | |
| 10 | 3 | 7.6 | 17.35 | 77.18 | 1.715 | 39.75 | 4.73 | 21.04 | 0.468 | 48.75 | 45 |
| | 1 | 2.5 | 20.36 | 90.57 | 2.01 | 16.60 | 6.12 | 27.22 | 0.605 | 21.00 | |
| | 0 | 0 | 24.10 | 107.20 | 2.38 | 12.00 | | | | | |
| 10C | 3 | 7.6 | 7.73 | 34.38 | 0.637 | 39.00 | 2.59 | 11.52 | 0.213 | 52.40 | 54 |
| | 1 | 2.5 | 8.75 | 38.92 | 0.721 | 14.40 | 3.22 | 14.32 | 0.265 | 28.80 | |
| | 0 | 0 | 10.36 | 46.08 | 0.853 | 22.40 | | | | | |
| 11 | 3 | 7.6 | 15.77 | 70.15 | 1.40 | 70.83 | 10.16 | 45.19 | 0.904 | 80.00 | 50 |
| | 1 | 2.5 | 16.21 | 72.11 | 1.44 | 27.40 | 11.65 | 51.82 | 1.036 | 34.00 | |
| | 0 | 0 | 18.05 | 80.29 | 1.61 | 24.60 | | | | | |
| 11C | 3 | 7.6 | 4.09 | 18.19 | 0.371 | 146.40 | 2.53 | 11.25 | 0.230 | 168.00 | 49 |
| | 1 | 2.5 | 4.60 | 20.46 | 0.418 | 59.40 | 2.66 | 11.83 | 0.241 | 71.00 | |
| | 0 | 0 | 5.84 | 25.98 | 0.530 | 42.80 | | | | | |
| 11X | 3 | 7.6 | 18.68 | 83.09 | 1.60 | 45.00 | 9.14 | 40.66 | 0.782 | 42.80 | 52 |
| | 1 | 2.5 | 21.81 | 97.02 | 1.87 | 17.20 | 13.40 | 59.61 | 1.15 | 16.80 | |
| | 0 | 0 | 27.62 | 122.86 | 2.36 | 20.00 | | | | | |
| 12 | 3 | 7.6 | 8.28 | 36.83 | 0.658 | 25.60 | 6.55 | 29.14 | 0.520 | 31.20 | 56 |
| | 1 | 2.5 | 10.91 | 48.53 | 0.867 | 10.83 | 6.83 | 30.38 | 0.543 | 12.60 | |
| | 0 | 0 | 24.56 | 109.25 | 1.951 | 12.60 | | | | | |
| 12C | 3 | 7.6 | 3.98 | 17.70 | 0.334 | 123.20 | 2.88 | 12.81 | 0.242 | 117.60 | 53 |
| | 1 | 2.5 | 4.12 | 18.33 | 0.346 | 51.20 | 3.28 | 14.59 | 0.275 | 52.40 | |
| | 0 | 0 | 4.94 | 21.97 | 0.415 | 18.00 | | | | | |
| 12X | 3 | 7.6 | 3.48 | 15.48 | 0.287 | 19.40 | 3.78 | 16.81 | 0.311 | 24.00 | 54 |
| | 1 | 2.5 | 7.37 | 32.78 | 0.607 | 9.40 | 6.91 | 30.74 | 0.569 | 11.40 | |
| | 0 | 0 | 19.06 | 84.78 | 1.570 | 56.40 | | | | | |

TABLE IV

| | 8 | 8C | 9 | 9C | 11 | 11C |
|---|---|---|---|---|---|---|
| Avg. Tear Force | | | | | | |
| MD (g) | 688 | 164 | 1916 | 680 | 880 | 1016 |
| TD (g) | 832 | 160 | 2084 | 1248 | 2160 | 1884 |
| MD (N) | 6.74 | 1.60 | 18.78 | 6.66 | 8.62 | 9.95 |
| TD (N) | 8.15 | 1.57 | 20.42 | 12.23 | 21.16 | 18.46 |
| Basis Weight $g/m^2$ | 55 | 54 | 51 | 52 | 52 | 49 |
| Avg. Tear Force Per Unit of Basis Weight | | | | | | |
| MD ($N/g/m^2$) | 0.122 | 0.03 | 0.37 | 0.13 | 0.166 | 0.203 |
| TD ($N/g/m^2$) | 0.148 | 0.029 | 0.400 | 0.23 | 0.407 | 0.377 |

EXAMPLE 13

As an illustration of a useful insulating web of the invention, a web was made comprising 65 weight-percent oriented melt-blown polypropylene microfibers made according to Example 1 (see Table V below for the specific conditions), and 35 weight-percent 6-denier crimped 1¼ inch (3.2 cm) polyethylene terephthalate staple fibers. The web was prepared by picking the crimped staple fiber with a lickerin roll (using apparatus as taught in U.S. Pat. No. 4,118,531) and introducing the picked staple fibers into the stream of oriented melt-blown fibers as the latter exited from the orienting chamber. The diameter of the microfibers was measured by SEM and found to range between 3 and 10 microns, with a mean diameter of 5.5 microns. The web had a very soft hand and draped readily when supported on an upright support such as a bottle.

For comparison, a similar web (13C) was prepared comprising the same crimped staple polyethylene terephthalate fibers and polypropylene microfibers prepared like the microfibers in the webs of the invention except that they did not pass through an orienting chamber.

Thermal insulating values were measured on the two webs before and after 10 washes in a Maytag clothes washer, and the results are given in Table VI.

TABLE V

| | Example No. | | |
|---|---|---|---|
| | 13 | 14 & 15 | 16 |
| Die Temperature (°C.) | 200 | 310 | 310 |
| Primary Air | | | |
| Pressure (psi) | 20 | 25 | 25 |
| (kPa) | 138 | 172 | 172 |
| Temperature (°C.) | 200 | 310 | 310 |
| Orienting Chamber | | | |
| Pressure (psi) | 70 | 70 | 70 |
| (kPa) | 483 | 483 | 483 |
| Temperature (°C.) | ambient | ambient | ambient |
| Rate of Polymer Extrusion | | | |
| (lb/hr/in) | 0.5 | 1 | 1 |
| (g/hr/cm) | 89 | 178 | 178 |

TABLE VI

| | Initial Measurement | | After 10 Washes | | Percent Loss | |
|---|---|---|---|---|---|---|
| Property Tested | Example 13 | Example 13C | Example 13 | Example 13C | Example 13 | Example 13C |
| Insulating Efficiency (clo) | 2.583 | 2.50 | 1.972 | 1.65 | 24 | 35 |
| Web Thickness (cm) | 1.37 | 1.4 | 1.12 | 0.98 | 18 | 30 |
| Web Weight (g/m$^2$) | 144 | 220 | | | | |
| Insulating Efficiency Per Unit of Thickness (clo/cm) | 1.88 | 1.78 | 1.76 | 1.66 | 6 | 7 |
| Insulating Efficiency Per Unit of Weight (clo/kg) | 17.9 | 11.4 | | | | |

EXAMPLE 14–15

Insulating webs of the invention were prepared which comprised 80 weight-percent oriented microfibers of polycyclohexane terephthalate (crystalline melting point 295° C.; Eastman Chemical Corp. 3879), made on apparatus as described in Example 2 using conditions as described in Table V, and 20 weight-percent 6-denier polyethylene terephthalate crimped staple fiber introduced into the stream of melt-blown oriented fibers in the manner described for Example 13. Two different webs of excellent drapability and soft hand were prepared having the basis weight described below in Table VII. Thermal insulating properties for the two webs are also given in Table VII.

TABLE VII

| | Example No. | | |
|---|---|---|---|
| | 14 | 15 | 16 |
| Weight (g/m$^2$) | 133 | 106 | 150 |
| Thickness (cm) | 0.73 | 0.71 | |
| Insulating Efficiency (clo) | 1.31 | 1.59 | |
| (clo/cm) | 1.79 | 2.24 | 1.63 |
| (clo-m$^2$/kg) | 9.8 | 15.0 | 13.9 |
| After Washed 10 Times Insulating Efficiency % Retained | 103.1 | 92.2 | 99.6 |
| Thickness (% Retained) | 97.3 | 98.6 | |

EXAMPLE 16

An insulating web of the invention was made comprising 65 weight-percent oriented melt-blown polycyclohexane terephthalate microfibers Eastman 3879) and 35 weight-percent 6-denier polyethylene terephthalate crimped staple fibers. Conditions for manufacture of the oriented melt-blown microfibers are as given in Table V, and measured properties were as given in Table VII. The web was of excellent drapability and soft hand.

EXAMPLE 17 AND 18

A first web of the invention (Example 17) was prepared according to Example 1, except that two dies were used as shown in FIG. 2. For the die 10*a*, the die temperature was 200° C., the primary air temperature and pressure were 200° C. and 15 psi (103 kPa), respectively, and the orienting chamber air temperature and pressure were ambient temperature and 70 psi (483 kPa), respectively. Polymer throughput rate was 0.5 lb/hr/in (89 g/hr/cm). The fibers leaving the orienting chamber were mixed with non-oriented melt-blown polypropylene fibers prepared in the die 10*b*. For die 10*b*, the die temperature was 270° C., and the primary air pressure and temperature were 30 psi (206 kPa) and 270° C., respectively. The polymer throughput rate was 0.5 lb/hr/in (89 g/hr/cm).

As a comparison, another web of the invention (Example 18) was prepared in the manner of Example 4, which comprised only oriented melt-blown fibers. Both the Example 17 and 18 webs were embossed at a rate of 18 feet per minute in a spot pattern (diamond-shaped spots about 0.54 square millimeters in area and occupying about 34 percent of the total area of the web) using a temperature of 275° F. (135° C.), and a pressure of 20 psi (138 kPa).

Both the Example 17 and 18 embossed webs were measured on an Instron tester for tensile strength versus strain in the machine direction, i.e., the direction of movement of the collector, and the cross direction, and the results are reported below in Table VIII.

TABLE VIII

| | MD | | | | CD | | | |
|---|---|---|---|---|---|---|---|---|
| | | | | Example 17 | | | | |
| Stress | | | | | | | | |
| (psi) | 1600 | 2400 | 2700 | 2950 | 1600 | 2350 | 2650 | 2850 |
| (kPa) | 11008 | 16512 | 18576 | 20296 | 11008 | 16168 | 18232 | 19608 |
| Strain % | 6 | 12 | 18 | 24 | 6 | 12 | 18 | 24 |
| | | | | Example 18 | | | | |
| Stress | | | | | | | | |
| (psi) | 2900 | 4000 | 4700 | 4500 | 550 | 750 | 925 | 1075 |
| (kPa) | 19952 | 27520 | 32336 | 31023 | 3784 | 5160 | 6364 | 7396 |
| Strain % | 6 | 12 | 18 | 24 | 6 | 12 | 18 | 24 |

We claim:

1. Nonwoven fabric comprising oriented microfibers having an average diameter of about 10 micrometers or less and crimped staple fibers blended with the microfibers to form a coherent handleable lofty resiliently compressible web.

2. Fabric of claim 1 in which the oriented microfibers exhibit interrupted ring patterns in a WAXS photograph.

3. Fabric of claim 1 in which the oriented microfibers comprise polyethylene terephthalate.

4. Fabric of claim 1 in which the crimped staple fibers comprise at least about 10 weight-percent of the web.

5. Fabric of claim 1 in which the web has a loft of at least 30 cubic centimeters per gram.

6. Garment comprising the fabric of claim 1 as an insulation layer in the garment.

7. Fabric of claim 1 in which the melt-blown fibers have a crystalline axial orientation function of at least 0.65.

8. Fabric of claim 1 in which the melt-blown fibers have a crystalline axial orientation function of at least 0.8.

9. Nonwoven fabric comprising oriented melt-blown fibers that have a crystalline orientation function of at least about 0.5 and non-oriented fibers being blended together as a coherent handleable web.

10. Nonwoven fabric of claim 9 in which the non-oriented fibers have a crystalline orientation function of substantially zero.

* * * * *

UNITED STATES PATENT AND TRADEMARK OFFICE

CERTIFICATE OF CORRECTION

PATENT NO. : 4,988,560

DATED : January 29, 1991

INVENTOR(S) : Daniel E. Meyer; Dennis L. Krueger; Hassan Bodaghi

It is certified that error appears in the above-identified patent and that said Letters Patent is hereby corrected as shown below:

Col. 7, line 23, "1" should be -- 2 --.

Col. 18, line 24, after "non-oriented" insert -- randomly entangled melt-blown fibers, the oriented and non-oriented --.

Signed and Sealed this

Eighteenth Day of August, 1992

*Attest:*

DOUGLAS B. COMER

*Attesting Officer*

*Acting Commissioner of Patents and Trademarks*